US012510341B2

(12) United States Patent
Kruger et al.

(10) Patent No.: US 12,510,341 B2
(45) Date of Patent: Dec. 30, 2025

(54) BLAST CONFIRMATION

(71) Applicant: DETNET SOUTH AFRICA (PTY) LTD, Johannesburg (ZA)

(72) Inventors: Michiel Jacobus Kruger, Johannesburg (ZA); Marinus Yates, Benoni (ZA); Daniel August Julien Louis Maurissens, Johannesburg (ZA); Brian E. Petted, Cedarburg, WI (US)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 87 days.

(21) Appl. No.: 18/572,598

(22) PCT Filed: Jun. 15, 2022

(86) PCT No.: PCT/ZA2022/050023

§ 371 (c)(1),
(2) Date: Dec. 20, 2023

(87) PCT Pub. No.: WO2022/272315

PCT Pub. Date: Dec. 29, 2022

(65) Prior Publication Data

US 2024/0302148 A1 Sep. 12, 2024

(30) Foreign Application Priority Data

Jun. 21, 2021 (ZA) ..... 2021/04220
Jun. 3, 2022 (ZA) ..... 2022/06185

(51) Int. Cl.
*F42D 1/055* (2006.01)
*F42D 5/02* (2006.01)

(52) U.S. Cl.
CPC ..... *F42D 1/055* (2013.01); *F42D 5/02* (2013.01)

(58) Field of Classification Search
CPC ..... F42D 1/00; F42D 1/02; F42D 1/04; F42D 1/042; F42D 1/045; F42D 1/05; F42D 1/055; F42D 65/02
(Continued)

(56) References Cited

U.S. PATENT DOCUMENTS 3,027,751 A 4/1962 David
3,381,521 A 5/1968 Caldecourt et al.
(Continued)

FOREIGN PATENT DOCUMENTS

AU 2017100291 A4 4/2017
EP 2567183 A2 3/2013
(Continued)

OTHER PUBLICATIONS

International Search Report and Written Opinion for Application No. PCT/ZA2022/050023 dated Sep. 16, 2022 (10 pages).
(Continued)

*Primary Examiner* — Troy Chambers
*Assistant Examiner* — Benjamin S Gomberg
(74) *Attorney, Agent, or Firm* — Michael Best & Friedrich LLP

(57) ABSTRACT

A communication module which is linked to a detonator which is initiated in response to a fire command signal, and wherein the communication module includes a transmitter which transmits a wireless signal which is dependent upon initiation of the detonator and which contains or conveys an identifier which uniquely identifies the detonator.

7 Claims, 2 Drawing Sheets

(58) Field of Classification Search
USPC ..... 102/217
See application file for complete search history.

(56) References Cited

U.S. PATENT DOCUMENTS

| | | | | |
|---|---|---|---|---|
| 3,408,855 | A | 11/1968 | Slykhouse | |
| 3,572,095 | A | 3/1971 | Kowalick | |
| 3,852,994 | A | 12/1974 | Pereda | |
| 4,313,380 | A | 2/1982 | Martner et al. | |
| 4,782,911 | A | 11/1988 | Dixon et al. | |
| 10,563,967 | B2 | 2/2020 | Muller | |
| 2005/0011389 | A1* | 1/2005 | Teowee | H04L 25/061 102/200 |
| 2005/0247109 | A1 | 11/2005 | Meyer et al. | |
| 2006/0130693 | A1* | 6/2006 | Teowee | F42B 3/122 102/215 |
| 2008/0098921 | A1* | 5/2008 | Labuschagne | F42D 1/055 102/214 |
| 2010/0175574 | A1* | 7/2010 | Nelson | F42C 15/40 102/215 |
| 2013/0098257 | A1 | 4/2013 | Goodridge et al. | |
| 2014/0311370 | A1* | 10/2014 | Koekemoer | F42C 11/001 102/217 |
| 2015/0075770 | A1* | 3/2015 | Fripp | E21B 47/138 166/381 |
| 2015/0159986 | A1* | 6/2015 | Schlenter | F42D 1/02 102/311 |
| 2016/0046538 | A1 | 2/2016 | Swanson | |
| 2017/0074625 | A1* | 3/2017 | Appleby | F42B 3/113 |
| 2017/0074630 | A1* | 3/2017 | Kotsonis | F42D 1/05 |
| 2020/0309497 | A1* | 10/2020 | Torrance | F42D 1/055 |
| 2022/0349693 | A1* | 11/2022 | Nielsen | H04B 5/263 |
| 2023/0296364 | A1* | 9/2023 | Teowee | F42D 1/055 102/215 |

FOREIGN PATENT DOCUMENTS

| | | | |
|---|---|---|---|
| KR | 20160114436 | A | 10/2016 |
| WO | 2006055991 | A1 | 5/2006 |
| WO | 2009025562 | A1 | 2/2009 |
| WO | 2014055024 | A1 | 4/2014 |
| WO | 2019071304 | A | 4/2019 |
| WO | 2019071304 | A1 | 4/2019 |

OTHER PUBLICATIONS

International Preliminary Report on Patentability for Application No. PCT/ZA2022/050023 dated Aug. 17, 2023 (7 pages).

Annex to International Preliminary Report on Patentability for Application No. PCT/ZA2022/050023 dated Mar. 24, 2023 (6 pages).

* cited by examiner

BLAST CONFIRMATION

CROSS REFERENCE TO RELATED APPLICATIONS

This application is a U.S. National Phase application of International Patent Application No. PCT/ZA2022/050023 filed Jun. 15, 2022 which claims priority to South Africa Patent Application ZA 2021/04220 filed Jun. 21, 2021 and to South Africa Patent Application ZA 2022/06185 filed Jun. 3, 2022, the entire contents of all of which are herein incorporated by reference.

BACKGROUND OF THE INVENTION

This invention relates to a blasting system which makes use of a plurality of detonators.

It is important for quality control and safety purposes to be able to ascertain, once a blasting system has been initiated, whether each detonator in the system was fired. A detonator which, for whatever reason, was not ignited is referred to as a misfired detonator.

After blasting has taken place a misfired detonator in rock or rubble released by the blast event can inadvertently be fired. This can cause injury or death to personnel or substantial damage to equipment. Remedial measures to address the situation which arises when a detonator misfires can be expensive and laborious to implement.

Detonators in wired electronic detonator initiation systems have only a limited capability to transmit a signal containing status information after a fire command has been sent. It is not generally possible to verify if a detonator has correctly been fired due to the effect of blasting on an electrical harness which is coupled to several detonators. To address this problem several techniques have been proposed for implementing a blast confirmation process but to a greater or lesser extent these techniques have limitations.

An electromagnetic pulse (EMP) technique is based on the detection of an electromagnetic pulse which is generated when an explosive is fired. Closely allied thereto are techniques which rely on the detection of audio signals and vibratory signals generated by an explosive process. These techniques which are responsive to the results of blasting are however unable to differentiate effectively between the initiation of several detonators taking place at essentially the same time for the effects of the various initiations are substantially identical to one another.

It has also been proposed to make use of visual surveys wherein one or more cameras are used to monitor a blast site. A drawback of this technique is that dust, smoke and debris generated by a blasting process unavoidably and unpredictably obscure vision.

An object of the present invention is to address at least to some extent the aforementioned situation.

SUMMARY OF THE INVENTION

The invention provides a detonator assembly which includes a control circuit, a detonator which in use initiates an explosive, conductors which connect the detonator to the control circuit which, in response to receipt of a blast signal from a blast controller, transmits a fire command signal at a time A via the conductors to the detonator thereby to cause initiation of the detonator at a time B, and a transmitter for transmitting a wireless signal, and wherein the operation of the transmitter is dependent, at least, upon initiation of the detonator.

Receipt of said wireless signal at a control centre is indicative of successful firing of the detonator.

The detonator assembly may include a memory unit in which is stored a unique identifier for the detonator assembly. The memory unit may be in the detonator or in or associated with the control circuit.

The control circuit may be included in a communication module.

The transmitted wireless signal may include the unique identifier so that the detonator assembly from which the wireless signal originated can be identified.

Identification information can be conveyed in any other appropriate way. It is possible for the detonator assembly to be identified by adapting the nature or type of the wireless signal. For example a modulation technique may be applied to or embodied in the wireless signal and such technique may be uniquely associated with the detonator assembly. Similarly the wireless signal may operate at a distinct frequency which is uniquely associated with the detonator assembly.

For discriminatory and data logging purposes the wireless signal may include the unique identifier.

Typically, if the firing process is successful (no misfire), the detonator assembly is destroyed at a time C due to an explosive effect resulting from initiation of the detonator at the time B.

The control circuit may be configured to be positioned at or close to a mouth of a borehole and the detonator may be used to initiate explosive in the borehole.

As indicated hereinbefore an object of the invention is to obtain confirmation, in a reliable manner, that a detonator has, in fact, in response to a fire command, been initiated. This objective can be achieved in one of several ways by the manner in which the operation of the transmitter is made dependent on the initiation of the detonator.

In a first embodiment of the invention the transmitter is enabled to transmit the wireless signal commencing at the time B i.e. upon initiation of the detonator. Receipt of the wireless signal, at a remote location from the detonator assembly, is interpreted as confirmation that the detonator has fired.

As an enhancement or modification to this technique the control circuit is configured to monitor or measure a parameter or characteristic which unavoidably arises or is generated upon initiation of the detonator at the time B e.g. a temperature change or light generation or any other parameter. With this modification the transmitter is enabled to start transmission of the wireless signal at the time B and the wireless signal is then transmitted until such time as a measurement of the characteristic in question has been made. Information on that measurement can then be included in the signal in any appropriate way and transmitted to a remote control point.

In a second embodiment of the invention the transmitter is enabled to commence transmission of the wireless signal at the time A and to transmit the wireless signal continuously up to the time B at which time the transmission of the wireless signal is stopped. Such stoppage is equated to confirmation that the detonator has been fired.

In a variation the transmitter is enabled to transmit a first wireless signal for a period commencing at or after the time A until the time B and then to transmit a second wireless signal, which is distinguishable from the first wireless signal, commencing at the time B and continuing thereafter for a time period within which a characteristic measurement of the explosive process is made so that information on the measurement can be contained in and transmitted via the second wireless signal.

The first wireless signal may be distinguished from the second wireless signal in any appropriate way. Thus the first wireless signal may be modulated in a first manner and the second wireless signal may be modulated in a second manner which enables the second wireless signal to be distinguished from the first wireless signal. The first wireless signal may for example be an up-chirp message and the second wireless signal may be a down-chirp message or vice versa. The first wireless signal may be at a first frequency and the second wireless signal may be at a second frequency.

A typical blasting system includes a blast controller, a plurality of boreholes at a blast site, each borehole being charged with explosive material, and a plurality of detonator assemblies respectively associated with the said plurality of boreholes and wherein each detonator assembly is initiated in a controlled manner in response to a blast signal from the blast controller. Signals from the respective detonator assemblies which provide confirmation in each instance of the initiation of the respective detonator assembly can be generated simultaneously or at closely spaced time intervals from one another. A large blast system can include thousands of detonators which are fired within seconds of one another. In order to ascertain in a reliable manner the fire/misfire status of each detonator assembly it is necessary to be able to distinguish a wireless signal transmitted from a first detonator assembly from a wireless signal transmitted essentially simultaneously from a second detonator assembly.

To achieve this objective each detonator assembly in the blasting system may be of the aforementioned kind and the wireless signals which are transmitted by the respective transmitters are selected to be distinguishable from one another irrespective of the fact that one wireless signal may overlap in time with another wireless signal or with a number of wireless signals.

A transmitted wireless signal can be modulated in a manner to promote multiplexing of simultaneously transmitted signals, from the detonator assemblies, that overlap in time in accordance with a blast plan delay profile. These multiplexing methods can include but are not limited to time-, frequency-, and amplitude-modulation, and phase shifting techniques.

It is possible to make use of a chosen multiplexing method so that, additionally, specific events in a detonator blast cycle can be identified and information thereon can be conveyed to a remote point. An application of this type would be to shift the phase of a wireless signal to indicate that an ignition event has occurred. The phase shift would be designed so that a receiver, with the capability to detect a phase shift, would be able to identify the time of the event. That time could be compared to reference data, independently generated, possibly beforehand, in order to assess the accuracy of the timing in the detonator initiation process.

Multiple signals in the blast system which are transmitted at the same time may be distinguishable using multiplexing methods. Additionally multiplexing methods, chosen for the purpose, can be used to indicate the occurrence of an event such as blast ignition, the emission of light or a temperature change etc.

The occurrence of an event can be indicated using orthogonality techniques in the phase of a signal. Another possibility is to stop transmission of the signal when the event occurs. The frequency at which the signal is transmitted can also be changed to designate a defined event.

As a practical feature to assist in a discrimination exercise of the aforementioned kind the time interval during which each transmitter, in a detonator assembly, transmits the wireless signal referred to, is kept to a minimum. This helps to reduce interference between the signals. The time interval may however be sufficiently long to enable a defined characteristic e.g. temperature, light, gas release, etc. of the explosive process to be measured and for information on that measurement to be included in the transmitted wireless signal. Various modulation techniques can be employed in this regard e.g. amplitude modulation, frequency modulation, phase modulation, spread spectrum modulation and chirp modulation.

For example in one approach to enable wireless signals which are close to one another in time and which possibly overlap with one another, to be distinguished, a first frequency spectrum can be assigned to a first detonator assembly and a second frequency spectrum which is distinguishable from the first frequency spectrum can be assigned to a second detonator assembly. This exercise can be repeated as appropriate.

The aforementioned approach may be adopted for detonator assemblies which are fired in the same time slot. In respect of detonator assemblies which are fired in a different time slot it is also possible to allocate the first frequency spectrum and the second frequency spectrum etc. to those detonator assemblies which otherwise could give rise to the problem which has been described. Thus those detonator assemblies which are fired in a first time slot and which are physically close to each other so that the respective confirmatory wireless signals cannot readily be distinguished from one another may be allocated respective distinct frequency spectrums or, as noted, different modulation techniques may be employed.

The wireless signal is transmitted to the blast controller. The blast controller may then compare the time of initiation of the detonator signal to a programmed initiation time of the detonator to assess the response of the detonator assembly to the fire command signal. In this way information relating to the accuracy of the detonator process is obtainable.

The invention further extends to a blast system which includes a blast controller, a plurality of boreholes at a blast site, each borehole being charged with explosive material, a plurality of detonator assemblies respectively associated with said plurality of boreholes, each detonator assembly including a communication module, a detonator which in use is positioned inside a borehole exposed to the explosive therein, and conductors which connect the detonator to the communication module, wherein the communication module includes a control circuit which in response to receipt of a blast signal from the blast controller transmits a fire command signal via the conductors to the detonator thereby to cause initiation of the detonator, and a transmitter for transmitting a wireless signal which is dependent, at least upon initiation of the detonator, and wherein at least said wireless signals which are transmitted simultaneously by said transmitters from said plurality of detonator assemblies are modulated to promote multiplexing of the signals.

The modulation technique can include but is not limited to time-, frequency- and amplitude-modulation, and phase shifting.

The communication module may be positioned at or close to a mouth of the borehole.

The wireless signals from the transmitters in said plurality of detonator assemblies may be transmitted in allocated time slots. To provide a means of distinguishing a first wireless signal from at least a second wireless signal when said first wireless signal and said second wireless signal are transmitted in the same time slot, the first wireless signal may be orthogonal relative to the second wireless signal.

The selected modulation technique can also be used to identify one or more specific blast events in a detonator blast cycle. An example of this approach is that the amplitude of the wireless signal would be gated off for a set period of time at the moment an ignition event is detected. The signal amplitude would then be gated on, after the said period of time, to allow a receiver to determine accurately the occurrence of the ignition event.

Additionally to assist in discrimination as aforesaid the duration of each time slot is kept to a minimum in order to reduce interference between wireless signals from different detonator assemblies.

Each wireless signal contains or conveys an identifier which uniquely identifies the detonator assembly from which the wireless signal originated. By referencing the unique identifiers received from the plurality of detonator assemblies to unique identifiers of the detonator assemblies which were used in the construction of the blasting system it is then possible to identify those detonator assemblies which did not fire.

Each borehole is also uniquely distinguishable from other boreholes using any appropriate system e.g. a geographic identification system, a borehole numbering system or the like. That information which is directly linked to the unique identifier of the detonator assembly used in the borehole allows the location of the misfired detonator to be ascertained.

The invention also provides a method of confirming firing of a detonator which includes the step of transmitting a wireless signal from the detonator, wherein said wireless signal is dependent at least upon initiation of the detonator.

Receipt of said wireless signal, at a control location, is indicative of successful firing of the detonator.

BRIEF DESCRIPTION OF THE DRAWINGS

The invention is further described by way of examples with reference to the accompanying drawings in which.

DESCRIPTION OF PREFERRED EMBODIMENTS

Figure 1:
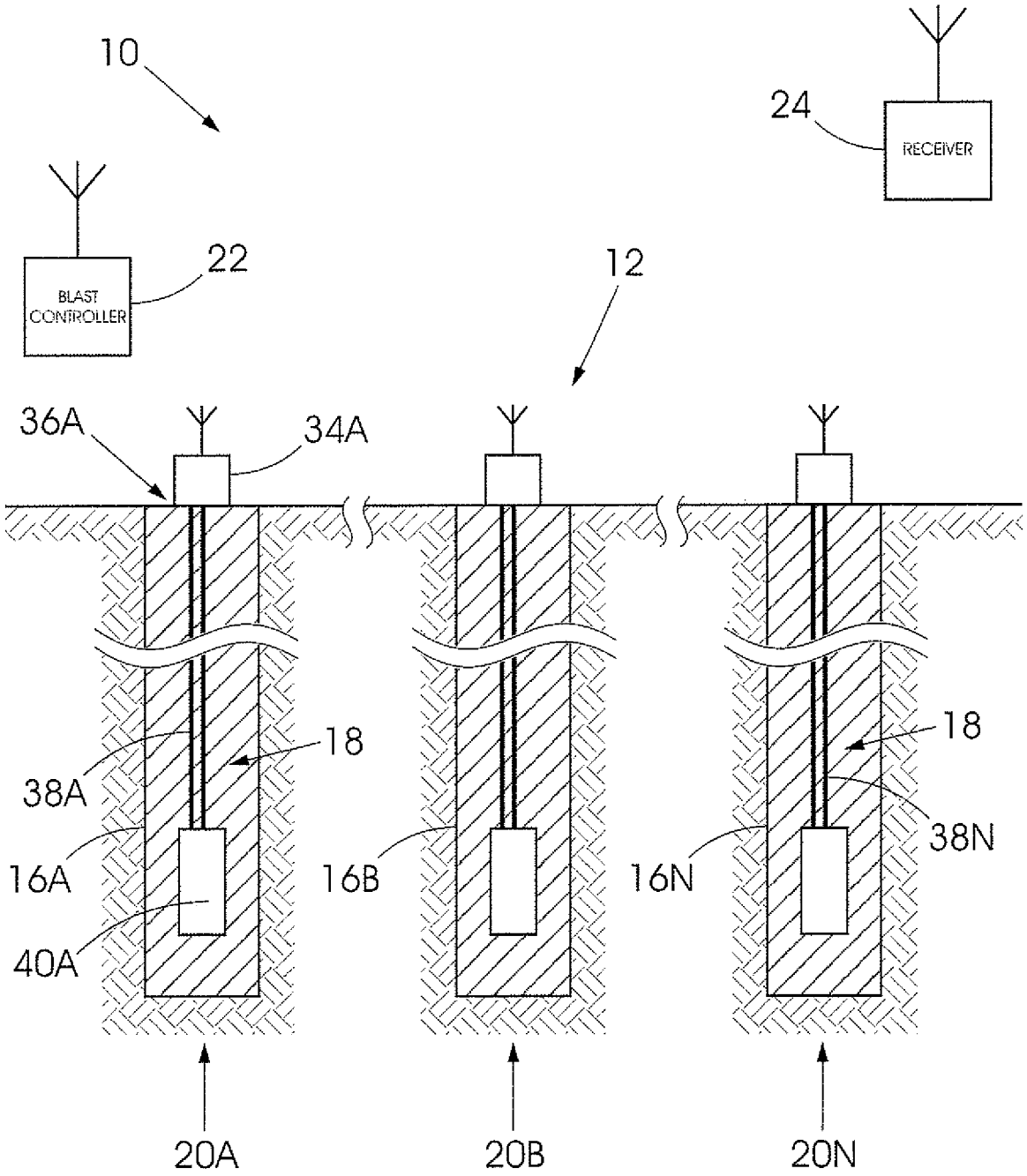
FIG. 1 illustrates aspects of a blasting system according to the invention.

FIG. 1 of the accompanying drawings schematically illustrates aspects of a blasting system 10 in which the principles of the invention are implemented.

The blasting system 10 includes a blast site 12 at which are formed a plurality of boreholes 16A, 16B . . . 16N at predetermined locations. Each borehole is charged with an explosive 18, as is known in the art.

The blasting system 10 includes a plurality of detonator assemblies 20A, 20B . . . 20N. Each detonator assembly is located in a respective borehole 16 exposed to the explosive 18 in the borehole.

The blasting system 10 includes a blast controller 22, and a receiver 24 which may be one of a number of similar receivers which are positioned at predetermined remote locations around the blast site 12. Alternatively the receiver is located at, or forms a part, of the blast controller 22. Depending on operational requirements it is possible to configure a selected detonator assembly to provide the function of a receiver 24 as is described hereinafter.

The detonator assemblies are physically substantially identical to one another although the operations thereof are not necessarily identical.

The detonator assembly 20A includes a communication module 34A which is configured to be positioned at an operative location relative to the borehole 16A at which the detonator assembly is to be used. Conveniently the module 34A is at a mouth 36A of the borehole 16A. The communication module 34A is connected by conductors 38A to a detonator 40A which is positioned at a desired depth in the borehole exposed to the explosive material 18.

Figure 2:
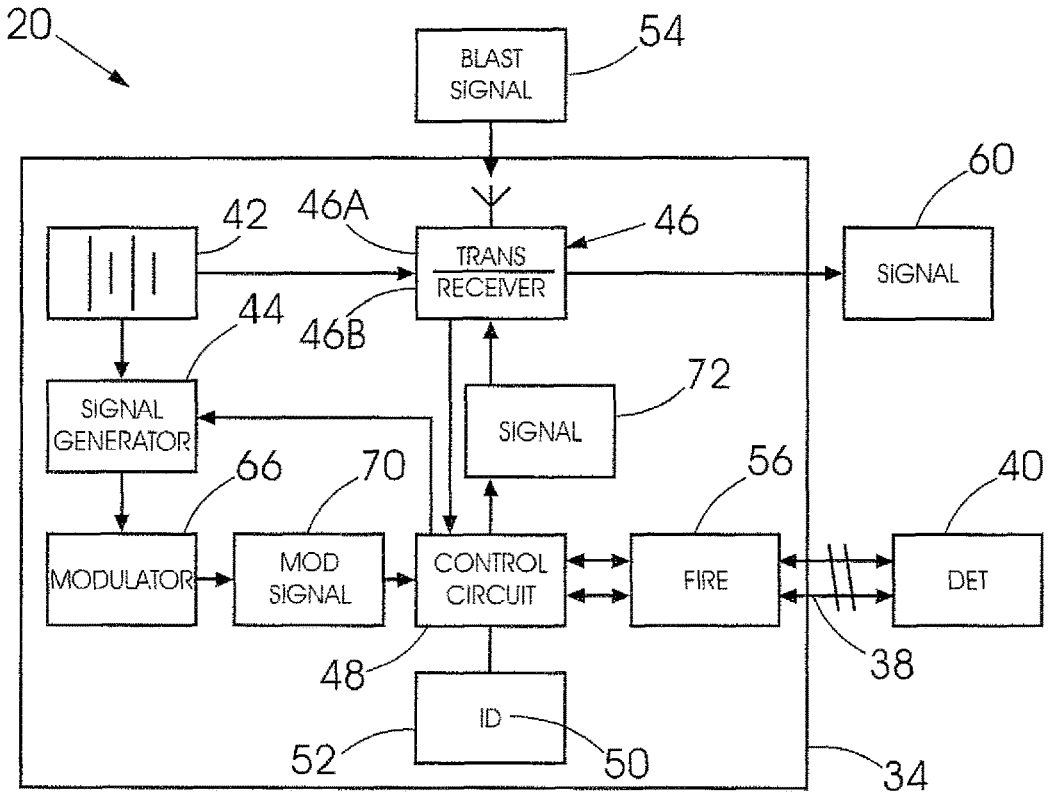
FIG. 2 illustrates in block diagram form some components of a detonator assembly according to the invention.

FIG. 2 shows in block diagram form a detonator assembly 20.

The communication module 34 includes a power source 42, a signal generator 44, a transmitter/receiver module 46 which comprises a transmitter 46A and a receiver 46B and a control circuit 48. The listing of these components is not exhaustive and is given to enable the principles of the invention to be understood. An identifier 50 which uniquely identifies the detonator assembly is stored in a memory unit 52 which is in the communication module 34 or in the detonator.

The blast controller 22 is used to execute a blasting sequence in the blasting system according to predefined protocols. After all prescribed initial checking and programming steps have been taken a stage is reached at which the blast controller 22 transmits a blast signal 54 to the various detonator assemblies 20A . . . 20N. In each case the blast signal 54 is received by the receiver 46B and validated by the control circuit 48. In accordance with predetermined rules, the control circuit 48 then transmits a fire command signal 56 via the conductors 38 to the detonator 40. The fire signal 56 causes the detonator 40 to initiate at a predetermined time and the explosive 18, exposed to the detonator, is ignited.

In order to obtain confirmation that a detonator 40 has been initiated and that there has not been a misfire the transmitter 46A is used to transmit a wireless signal 60 to the receiver 24. The operation of the transmitter 46A is made dependent at least upon initiation of the detonator in any of a number of ways which are depicted graphically in FIG. 3.

The wireless signal 60 includes the identifier 50 which uniquely identifies the detonator assembly 20. This identifier 50 is linked to an identifier of the borehole 16 at which the detonator assembly 20 is used. The borehole can be numerically designated or it can be designated by means of its geographical position i.e. through the use of appropriate coordinates. That information is kept in a database which is accessible by a control computer, not shown, linked in any suitable way to the blast controller 22 and to the receiver 24.

The wireless signal 60 is produced in a controlled manner by the function of the control circuit 48 which actuates the signal generator 44. A signal produced by the signal generator is subjected to a modulation technique by a modulator 66, as is described hereinafter. The resulting modulated signal 70 is applied to the control circuit 48 and combined with the identifier 50 to produce a signal 72 which then, via the transmitter 46B, constitutes the wireless signal 60 which is transmitted from the detonator assembly 20.

At a blast site which includes a large number of boreholes and detonator assemblies, of the order of several thousand, technical challenges arise in distinguishing a wireless signal 60X sent from a detonator assembly 20X, from a wireless signal 60Y sent from a detonator assembly 20Y. The difficulty is compounded when the respective wireless signals, possibly from a large number of detonator assemblies, are sent simultaneously or substantially simultaneously i.e. with only a very small time interval between the actual transmission times of the wireless signals.

Despite this difficulty the transmission of a wireless signal from a detonator assembly 20 which confirms initiation of the detonator 40 presents an opportunity for information on one or more selected aspects of the detonation process, which can be collected or observed within a short time interval, to be included in the wireless signal 60.

Figure 3:
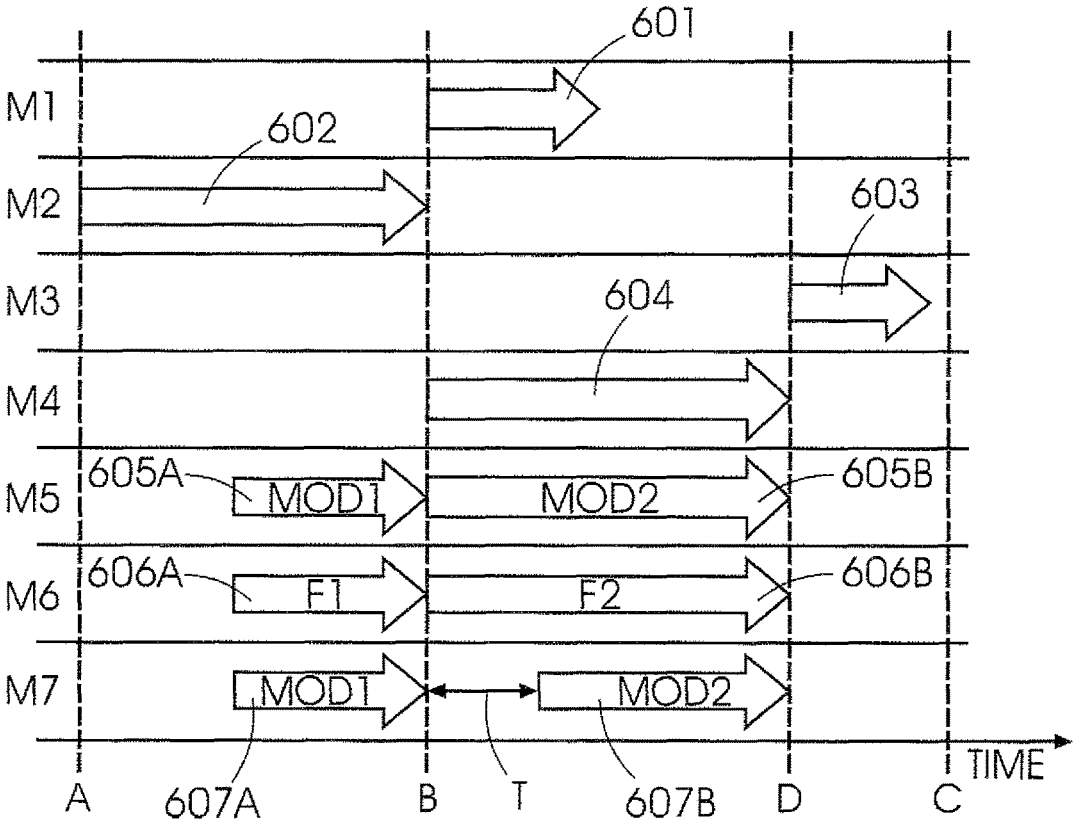
FIG. 3 is a graphical depiction of different inventive techniques upon which the operation of the detonator assembly of the invention can be based.

FIG. 3 graphically depicts different methods for controlling a transmitter to generate a confirmatory wireless signal, optionally with the inclusion of data which is generated by the blasting process.

FIG. 3 shows a horizontally extending timeline with spaced apart transversely extending dotted lines marked A, B, C and D respectively. In respect of any given detonator assembly 20 the time A is the time at which the fire command signal 56 is sent by the control circuit 48 via the conductors 38 to the associated detonator 40.

The time B is the time at which the detonator is initiated, after a predetermined and programmed time delay interval, in response to the fire command signal 56.

The time C is a time at which the detonator assembly 20 has been consumed after ignition of the explosive 18.

The time D is a parameter which marks the end of a time interval, after the time B, which time interval is optionally used and which is of sufficient duration to enable measurements to be made of one or more events which are associated with the initiation of the explosive 16.

In a first technique designated M1 in FIG. 3, the transmitter 46A is caused to transmit a wireless signal 601 of relatively short duration starting at the time B.

In accordance with a second method M2 the transmitter 46A is caused to transmit a signal 602 starting at the time A or at any time after the time A but before the time B. What is important in this respect is that the signal 602 terminates at the time B i.e. when initiation is detected.

In a third method M3 the transmitter 46A is kept inoperative until the time D. A signal 603 is then transmitted. This is before the time C for, at the time C, the detonator assembly is destroyed by the ignited explosive 18.

In a method M4 transmission of a wireless signal 604 commences at the time B and ends at the time D. As may be appropriate selected information on the detonator and detonation process can be included in the signal 604.

In a method M5 transmission of a first signal 605A commences at the time A, or at any time after the time A but before the time B. Transmission of the signal 605A ends at the time B. Thereafter a second signal 605B is transmitted from the time B up to the time D.

The signals 605A and 605B can be distinguished from each other through the use of an appropriate modulation technique (MOD1, MOD2). For example the signal 605A may comprise an up-chirp signal while the signal 605B may comprise a down-chirp signal.

A method M6 is similar to the method M5 in that transmission of a first signal 606A commences at or after the time A and is continued up to the time B. This is followed by a second signal 606B the transmission of which commences at the time B and ends at the time D or prior thereto. The signals 606A and 606B are distinguished from each other by using different frequencies (F1, F2) for their transmissions.

A method M7 is similar to the method M5 in that transmission of a first signal 607A commences at or after time A and is continued up to the time B. This is followed optionally, after an interval of duration T, by transmission of a second signal 607B which can continue for a predetermined time interval which ends before the time C e.g. up to the time D. The signals 607A and 607B do not necessarily have to be distinguished from each other in that the receiver 24 associated with the blast controller has the capability to detect the stop-start in the transmission i.e. the stopping of the transmission of the signal 607A at the time B and the starting of the transmission of the signal 607B at or after the time B.

The blast confirmation process which has been described is based on the transmission of a signal where such transmission is dependent on detecting the ignition of a detonator. Also the transmission must take place before the transmitter which is used for transmitting the signal is destroyed by the explosive process. If the signals which are transmitted in the aforementioned way are reliably generated and transmitted and detected then the blast confirmation process as described herein works effectively. It does however fall within the scope of the invention for one or more additional techniques, linked to the effects of blasting, to be used in conjunction with the detection of the blast confirmation signal. These additional techniques are used to enhance the accuracy of the blast confirmation process for despite careful design errors can arise in signal generation, transmission, receipt and interpretation. As indicated hereinbefore an electromagnetic pulse is generated when an explosive is fired. Detection of that pulse is confirmatory of successful initiation. Audio signals and vibratory signals caused by an explosive process also indicate successful initiation. Visual surveys which rely for example on the use of cameras can monitor a blast site. These processes, taken in isolation can be defective in that due to various physical factors closely timed detonator firings are not easily distinguishable from each other. Despite inherent limitations in the observational methods they can however, with benefit, where possible be used in conjunction with the blast confirmation signal transmission technique described herein, and correlated therewith, in order to improve the reliability of blast detection.

FIG. 3 thus graphically depicts different ways in which a wireless signal can be transmitted from a detonator assembly to confirm initiation of the associated detonator and, where required, to transfer information relating to the velocity of detonation. This facility is implemented for each detonator assembly 20 in the blasting system. The different techniques in FIG. 3 are implemented at least by making the operation of the transmitter 46A dependent on initiation of the detonator. In the methods M2, M5 and M6 the transmissions of signals which commence prior to the time B are terminated at the time B. In the methods M1, M4, M5 and M6 the wireless signals are transmitted commencing at the time B. In the method M3 a signal is transmitted starting at the time D.

The confirmatory signals which are transmitted in any of the ways described in connection with FIG. 3 contain the respective identifiers 50 of the detonator assemblies 20 from which the wireless signals originated. In this way misfired detonators 40 in the blasting system can be identified in real time or after blasting by post-processing the signals received at a common point e.g. at the receiver 24 or, if multiple receivers are used, at a single node to which the receivers are linked. The boreholes at which the misfired detonators were placed can also then be identified and appropriate remedial or corrective action in respect of the misfires can take place.

In a large blasting system with several thousand detonators the confirmatory signals coming from the various detonator assemblies must be distinguished from one another even though at least some of such signals may have been transmitted at the same time or within closely spaced time intervals from one another. To achieve this type of discrimination the wireless signals 60 coming from the different detonator assemblies are multiplexed using various techniques.

The preceding description relates generally to a blast confirmation process wherein a wireless signal is transmitted from a detonator to a central controller (the receiver) to confirm that it has blasted. In some embodiments this transmission of the signal occurs immediately before initiation at the time B. As the confirmatory signal is transmitted at a precisely determined time it is possible to measure the accuracy of the detonator's response to a fire command signal from the control circuit 48. For example if a detonator were programmed to initiate with a delay of 2000 milliseconds after receipt of the fire command signal and a signal confirming initiation is received indicating, say, a delay of 2003 milliseconds then it can be determined that the firing accuracy was 3 milliseconds after the specified time. The accuracy of firing can then be calculated. Similar calculations can be done for all of the detonators in the blasting system. This type of information can be used to verify the effectiveness of the blast process and can provide data which allows for future blasting processes to be enhanced.

The invention claimed is:

1. A blast system which includes: a blast controller, a plurality of boreholes at a blast site, each borehole being charged with explosive material, a plurality of detonator assemblies respectively associated with said plurality of boreholes, each detonator assembly including a communication module which is positioned at or close to a mouth of a borehole of the plurality of boreholes, a detonator which, in use, is positioned inside a borehole of the plurality of boreholes and exposed to the explosive material therein, and conductors which connect the detonator to the communication module, wherein the communication module includes a control circuit which, in response to receipt of a blast signal from the blast controller, transmits a fire command signal at a time A via the conductors to the detonator to cause initiation of the detonator at a time B, and a transmitter for transmitting a wireless signal, to the blast controller, said wireless signal contains or conveys an identifier which uniquely identifies the detonator assembly from which the wireless signal originated, said wireless signal being dependent, at least upon initiation of the detonator, wherein the transmission of said wireless signal from the detonator is selected from the following: (a) the transmission of the wireless signal commencing at the time B; (b) the wireless signal is transmitted at least for a period at the time B within which a measurement is made of the velocity of detonation of the explosive in the borehole upon initiation of the detonator from which the wireless signal originates; (c) the wireless signal is transmitted continuously at or after the time A up to the time B; and (d) the wireless signal is transmitted at the end of a time interval after the time B which is of sufficient duration to enable a measurement to be made of the velocity of detonation of the initiation of the explosive in the borehole from which the wireless signal originates, and wherein at least said wireless signals which are transmitted simultaneously by said transmitters from said plurality of detonator assemblies are modulated to promote multiplexing of the wireless signals.

2. A blast system according to claim 1 wherein each of the wireless signals is modulated by a technique selected from time-, frequency-, and amplitude-modulation, and phase shifting.

3. A blast system according to claim 2 wherein the modulation technique is used to identify one or more specific blast events.

4. A blast system according to claim 1 wherein each detonator assembly respectively includes a memory unit in which is stored a unique identifier for the detonator assembly.

5. A blast system according to claim 1 wherein each transmitted wireless signal is adapted to identify the detonator assembly from which the wireless signal was transmitted.

6. A blast system according to claim 1 wherein the respective wireless signal transmitted from each detonator assembly contains information on the time of initiation of the detonator, and wherein the blast controller compares said time of initiation of the detonator to a programmed initiation time of the detonator to assess the response of the detonator assembly to the fire command signal.

7. A blast system according to claim 1 wherein the blast controller is configured to correlate receipt of each respective wireless signal with information relating to one or more of the following effects of blasting: electromagnetic pulse generation, sound generation, vibration generation, and visual observation.

* * * * *